US011986072B2

(12) United States Patent
Wu

(10) Patent No.: US 11,986,072 B2
(45) Date of Patent: May 21, 2024

(54) ZIPPER COVER ARRANGEMENT FOR LUGGAGE AND BAGS

(71) Applicant: TUMI, INC., Edison, NJ (US)

(72) Inventor: Peter C. Wu, Sunnyside, NY (US)

(73) Assignee: TUMI, INC., Edison, NJ (US)

( * ) Notice: Subject to any disclaimer, the term of this patent is extended or adjusted under 35 U.S.C. 154(b) by 372 days.

(21) Appl. No.: 17/420,313

(22) PCT Filed: Jan. 3, 2019

(86) PCT No.: PCT/US2019/012201
§ 371 (c)(1),
(2) Date: Jul. 1, 2021

(87) PCT Pub. No.: WO2020/142100
PCT Pub. Date: Jul. 9, 2020

(65) Prior Publication Data

US 2022/0087390 A1 Mar. 24, 2022

(51) Int. Cl.
*A45C 13/10* (2006.01)
*A45C 5/03* (2006.01)

(52) U.S. Cl.
CPC ..... *A45C 13/1069* (2013.01); *A45C 13/103* (2013.01); *A45C 5/03* (2013.01)

(58) Field of Classification Search
CPC ..... A45C 13/1069; A45C 13/103; A45C 5/03
See application file for complete search history.

(56) References Cited

U.S. PATENT DOCUMENTS

| | | | |
|---|---|---|---|
| D18,875 | S | 1/1889 | Carpeles |
| D65,858 | S | 10/1924 | Hamilton |
| D67,730 | S | 6/1925 | Chen |
| D67,941 | S | 8/1925 | Bartlett |

(Continued)

FOREIGN PATENT DOCUMENTS

| | | | |
|---|---|---|---|
| CN | 85105303 | A | 1/1987 |
| CN | 2468346 | Y | 1/2002 |

(Continued)

OTHER PUBLICATIONS

Second Office Action in corresponding Chinese Application No. 201710018617.X dated Nov. 14, 2018.

(Continued)

*Primary Examiner* — Tara Schimpf
*Assistant Examiner* — Matthew J Sullivan
(74) *Attorney, Agent, or Firm* — Lando & Anastasi, LLP

(57) ABSTRACT

An article includes a zipper cover (14, 114) configured to conceal a zipper tape (18, 118) that is secured at a mouth of a zippered opening in a surface of the article and to longitudinally extend substantially parallel to the zipper tape. The zipper cover (14, 114) is attached to the surface of the article (10, 110) and is rotatable between a first orientation in which the zipper cover (14, 114) conceals the zipper tape (18, 118) and a second orientation in which the zipper cover exposes the zipper tape (18, 118) and allows a user to access the zippered opening. The zipper cover (14, 114) is magnetically securable to a surface (32, 132) of the zippered opening in the first orientation, and the zipper cover (14, 114) is magnetically securable against the surface (20, 120) of the article in the second orientation.

23 Claims, 10 Drawing Sheets

(56) References Cited

U.S. PATENT DOCUMENTS

| | | | |
|---|---|---|---|
| 1,573,721 | A | 2/1926 | Loeffer |
| 1,619,561 | A | 3/1927 | Bolz |
| 2,002,878 | A | 5/1935 | Belber |
| 2,541,514 | A | 2/1951 | Herold |
| 2,710,084 | A | 6/1955 | Braverman |
| 2,798,579 | A | 7/1957 | Fox |
| 2,903,033 | A | 9/1959 | Robinson |
| 2,987,908 | A | 6/1961 | Pelcin |
| 3,046,043 | A | 7/1962 | Matteson |
| 3,147,908 | A | 9/1964 | Clemens |
| 3,450,237 | A | 6/1969 | Dyke |
| 3,480,118 | A | 11/1969 | Dyke |
| 3,623,580 | A | 11/1971 | Toller |
| 3,832,264 | A | 8/1974 | Barnette |
| 3,962,010 | A | 6/1976 | Riou et al. |
| D246,939 | S | 1/1978 | Casser |
| 4,116,027 | A | 9/1978 | Tannery |
| 4,128,150 | A | 12/1978 | Popkin et al. |
| 4,327,462 | A | 5/1982 | Eggleston |
| 5,251,731 | A | 10/1993 | Cassese et al. |
| 5,299,844 | A | 4/1994 | Gleason |
| 5,374,073 | A | 12/1994 | Hung-Hsin |
| D358,031 | S | 5/1995 | Aumasson |
| 5,447,217 | A | 9/1995 | Chou |
| D364,504 | S | 11/1995 | Bieber et al. |
| 5,499,426 | A | 3/1996 | Hsieh |
| 5,526,908 | A | 6/1996 | Wang |
| 5,575,362 | A | 11/1996 | Franklin et al. |
| 5,613,273 | A | 3/1997 | Tsai |
| 5,642,552 | A | 7/1997 | Wang |
| 5,645,146 | A | 7/1997 | Bieber et al. |
| 5,653,319 | A | 8/1997 | Wang |
| 5,655,260 | A | 8/1997 | Chang |
| D383,664 | S | 9/1997 | Bennett |
| D385,699 | S | 11/1997 | Lin |
| 5,743,363 | A | 4/1998 | Rekuc et al. |
| 5,782,325 | A | 7/1998 | O'Shea et al. |
| 5,803,214 | A | 9/1998 | Wang |
| 5,806,143 | A | 9/1998 | Tsai |
| 5,816,374 | A | 10/1998 | Hsien |
| 5,909,760 | A | 6/1999 | Tsai |
| 5,927,451 | A | 7/1999 | Tsai |
| 5,934,716 | A | 8/1999 | Koveal et al. |
| D414,933 | S | 10/1999 | Yu |
| D415,614 | S | 10/1999 | Akaike et al. |
| 5,983,682 | A | 11/1999 | Parikh |
| D421,338 | S | 3/2000 | Moon |
| D425,705 | S | 5/2000 | Santy et al. |
| D427,434 | S | 7/2000 | King et al. |
| D429,141 | S | 8/2000 | Antonucci et al. |
| D430,792 | S | 9/2000 | Wang |
| 6,134,749 | A | 10/2000 | Kuo |
| 6,179,025 | B1 | 1/2001 | Sutton |
| 6,186,295 | B1 | 2/2001 | Lin et al. |
| 6,193,324 | B1 | 2/2001 | Chang |
| D438,382 | S | 3/2001 | Chang |
| D439,410 | S | 3/2001 | Chang |
| 6,220,412 | B1 | 4/2001 | Lin |
| 6,223,391 | B1 | 5/2001 | Kuo |
| 6,247,203 | B1 | 6/2001 | Kuo |
| D447,929 | S | 9/2001 | Chang |
| 6,289,554 | B1 | 9/2001 | Wang |
| 6,347,432 | B1 | 2/2002 | Kuo |
| 6,360,400 | B1 | 3/2002 | Chang |
| D456,993 | S | 5/2002 | Lin et al. |
| 6,401,890 | B1 | 6/2002 | Tan |
| D459,579 | S | 7/2002 | Kegels |
| D460,263 | S | 7/2002 | Bradford |
| 6,454,066 | B1 | 9/2002 | Chen |
| D463,909 | S | 10/2002 | Carter |
| D472,705 | S | 4/2003 | Van Himbeeck |
| 6,598,433 | B1 | 7/2003 | Malvasio |
| 6,604,617 | B2 | 8/2003 | Davis et al. |
| D483,646 | S | 12/2003 | Teskey et al. |
| D484,028 | S | 12/2003 | Moon |
| D485,681 | S | 1/2004 | Fenton et al. |
| D491,365 | S | 6/2004 | Proot |
| D495,879 | S | 9/2004 | Bernbaum et al. |
| D503,536 | S | 4/2005 | Rada et al. |
| D504,803 | S | 5/2005 | Misner et al. |
| 6,936,127 | B2 | 8/2005 | Fenton et al. |
| D509,359 | S | 9/2005 | Chang |
| D511,620 | S | 11/2005 | Van Himbeeck |
| D513,560 | S | 1/2006 | Neumann |
| D515,814 | S | 2/2006 | Fenton et al. |
| D518,295 | S | 4/2006 | Fenton |
| D521,236 | S | 5/2006 | Weng et al. |
| 7,066,311 | B2 | 6/2006 | O'Shea |
| 7,082,641 | B1 | 8/2006 | Jung et al. |
| 7,195,109 | B2 | 3/2007 | Mitchell et al. |
| D539,543 | S | 4/2007 | Wu |
| D540,540 | S | 4/2007 | Szyf et al. |
| D541,530 | S | 5/2007 | Sijmons |
| 7,281,616 | B2 | 10/2007 | Peterson et al. |
| D563,101 | S | 3/2008 | Kuchler |
| 7,374,183 | B1 | 5/2008 | Yen-Lung |
| D572,577 | S | 7/2008 | Hatton |
| D575,512 | S | 8/2008 | Moon |
| D575,513 | S | 8/2008 | Siegel |
| D575,957 | S | 9/2008 | Scicluna et al. |
| D576,407 | S | 9/2008 | Moon |
| D581,161 | S | 11/2008 | Tong |
| D581,667 | S | 12/2008 | Yeh |
| D582,678 | S | 12/2008 | Rekuc et al. |
| 7,464,569 | B2 | 12/2008 | Kolton et al. |
| D587,902 | S | 3/2009 | Yoneno |
| D590,595 | S | 4/2009 | Chu et al. |
| D596,400 | S | 7/2009 | Chu et al. |
| D601,342 | S | 10/2009 | Choi |
| D601,344 | S | 10/2009 | Chu et al. |
| D601,802 | S | 10/2009 | Chu et al. |
| D603,608 | S | 11/2009 | Chu et al. |
| D604,953 | S | 12/2009 | Chu et al. |
| D605,857 | S | 12/2009 | Chu et al. |
| D607,642 | S | 1/2010 | Chu et al. |
| 7,641,030 | B2 | 1/2010 | Selvi |
| D619,365 | S | 7/2010 | Chu et al. |
| D619,810 | S | 7/2010 | Huang |
| D621,156 | S | 8/2010 | Chu et al. |
| D622,060 | S | 8/2010 | Scicluna et al. |
| D623,856 | S | 9/2010 | Pezzini |
| D627,162 | S | 11/2010 | Weng |
| D627,564 | S | 11/2010 | Chu et al. |
| D629,200 | S | 12/2010 | Turella-Yuan et al. |
| D630,850 | S | 1/2011 | Gifford |
| D639,555 | S | 6/2011 | Moon |
| D640,868 | S | 7/2011 | Jongchul |
| D642,379 | S | 8/2011 | Buller |
| D643,624 | S | 8/2011 | Hong |
| D644,436 | S | 9/2011 | Buller |
| D644,838 | S | 9/2011 | Tong |
| D652,216 | S | 1/2012 | Fair |
| D659,395 | S | 5/2012 | Sijmons |
| D665,997 | S | 8/2012 | Meersschaert |
| D667,636 | S | 9/2012 | Maglieri |
| 8,272,100 | B2 | 9/2012 | Scicluna |
| D668,049 | S | 10/2012 | Buller |
| D675,017 | S | 1/2013 | Van Overbeke |
| 8,359,708 | B2 | 1/2013 | Scicluna |
| D677,899 | S | 3/2013 | Cenzano et al. |
| D679,090 | S | 4/2013 | Du |
| D683,539 | S | 6/2013 | Jobert |
| 8,479,900 | B2 | 7/2013 | Scicluna |
| D690,510 | S | 10/2013 | Fux |
| 8,752,683 | B2 | 6/2014 | Scicluna |
| D710,610 | S | 8/2014 | Sijmons et al. |
| D711,104 | S | 8/2014 | Lai |
| D714,057 | S | 9/2014 | Hou |
| RE45,437 | E | 3/2015 | Morelli |
| D728,933 | S | 5/2015 | Sanz et al. |
| D731,181 | S | 6/2015 | Majeau et al. |
| D731,796 | S | 6/2015 | Tong |
| D741,600 | S | 10/2015 | Della Vecchia |
| D748,918 | S | 2/2016 | Majeau |

(56) References Cited

U.S. PATENT DOCUMENTS

| | | | | |
|---|---|---|---|---|
| D758,070 | S | 6/2016 | Frohlich | |
| D774,758 | S | 12/2016 | Hopwood et al. | |
| D780,451 | S | 3/2017 | Wu | |
| D783,282 | S | 4/2017 | Sijmons | |
| D785,937 | S | 5/2017 | Morszeck | |
| D796,838 | S | 9/2017 | Sijmons et al. | |
| D805,772 | S | 12/2017 | Oshima | |
| D809,294 | S | 2/2018 | Tong | |
| 9,894,971 | B2 | 2/2018 | Scicluna et al. | |
| 9,961,974 | B2 | 5/2018 | Hillaert et al. | |
| D824,168 | S | 7/2018 | Morszeck | |
| D825,920 | S | 8/2018 | Scicluna | |
| D853,722 | S | 7/2019 | Wu | |
| D858,100 | S | 9/2019 | Dong | |
| D859,834 | S | 9/2019 | Wu | |
| D862,880 | S | 10/2019 | Evangelista et al. | |
| D872,472 | S | 1/2020 | Wu | |
| D874,820 | S | 2/2020 | Suarez et al. | |
| D878,046 | S | 3/2020 | Wu | |
| D882,948 | S | 5/2020 | Xu | |
| 10,649,465 | B1 | 5/2020 | Tang et al. | |
| D905,961 | S | 12/2020 | Sanz | |
| D907,920 | S | 1/2021 | Li | |
| 10,901,459 | B1 * | 1/2021 | Nedrelow | G06F 1/1628 |
| 10,954,055 | B2 * | 3/2021 | Rogers | A45C 7/00 |
| 11,166,532 | B2 * | 11/2021 | Judy | A45C 13/1069 |
| 11,202,490 | B1 * | 12/2021 | Lloyd | A45C 13/103 |
| 11,690,431 | B2 * | 7/2023 | DeGroot | A45C 13/26 224/183 |
| 2002/0105798 | A1 | 8/2002 | Hill | |
| 2002/0153074 | A1 * | 10/2002 | Chen | A45C 1/024 190/110 |
| 2003/0009848 | A1 | 1/2003 | Kuo | |
| 2003/0038007 | A1 | 2/2003 | Han | |
| 2003/0178888 | A1 | 9/2003 | Chang | |
| 2004/0101669 | A1 | 5/2004 | Chang | |
| 2004/0163208 | A1 | 8/2004 | Kuo | |
| 2005/0034947 | A1 | 2/2005 | Nykoluk | |
| 2006/0201595 | A1 * | 9/2006 | Carmichael | A45C 1/04 206/83 |
| 2006/0225981 | A1 | 10/2006 | Lin | |
| 2007/0193902 | A1 * | 8/2007 | Myers | A45C 13/1069 206/320 |
| 2008/0053771 | A1 | 3/2008 | Wu | |
| 2009/0095588 | A1 | 4/2009 | Thomas | |
| 2009/0218186 | A1 * | 9/2009 | Sherr | A45C 5/03 190/111 |
| 2009/0321204 | A1 | 12/2009 | Barkow et al. | |
| 2010/0095480 | A1 | 4/2010 | Scicluna | |
| 2010/0101971 | A1 | 4/2010 | Chisholm | |
| 2010/0230223 | A1 | 9/2010 | Wu | |
| 2010/0300825 | A1 | 12/2010 | Nordstrom | |
| 2011/0056788 | A1 | 3/2011 | Jackson | |
| 2011/0239401 | A1 | 10/2011 | Scicluna | |
| 2012/0103740 | A1 | 5/2012 | Moussatche et al. | |
| 2012/0175207 | A1 | 7/2012 | Scicluna | |
| 2012/0180259 | A1 | 7/2012 | Frame | |
| 2012/0325606 | A1 | 12/2012 | Scicluna | |
| 2013/0068579 | A1 | 3/2013 | Mathieu et al. | |
| 2013/0140119 | A1 | 6/2013 | Hogan et al. | |
| 2014/0311844 | A1 | 10/2014 | Meersschaert et al. | |
| 2015/0111623 | A1 | 4/2015 | Hegemier et al. | |
| 2017/0020250 | A1 * | 1/2017 | Boschan | A45C 3/001 |
| 2017/0190372 | A1 * | 7/2017 | Rucker | B62J 9/25 |
| 2017/0280840 | A1 * | 10/2017 | Platt | A45C 1/02 |
| 2018/0220757 | A1 * | 8/2018 | Brundage | A45C 13/03 |
| 2019/0090390 | A1 * | 3/2019 | Judy | A45C 13/1069 |
| 2019/0269216 | A1 * | 9/2019 | Faleti | A45C 13/103 |
| 2020/0060399 | A1 * | 2/2020 | Seminara | A45C 13/00 |
| 2021/0068519 | A1 * | 3/2021 | Rogers | A45C 13/103 |
| 2021/0105916 | A1 * | 4/2021 | Judy | H05K 9/0009 |
| 2021/0330046 | A1 * | 10/2021 | Svensson | A45C 13/083 |
| 2023/0210236 | A1 * | 7/2023 | Fiedler | A45C 13/008 292/251.5 |

FOREIGN PATENT DOCUMENTS

| | | | | |
|---|---|---|---|---|
| CN | 2653952 | Y | 11/2004 | |
| CN | 101686745 | A | 3/2010 | |
| CN | 201595333 | U | 10/2010 | |
| CN | 201633468 | U | 11/2010 | |
| CN | 102059918 | A | 5/2011 | |
| CN | 103112309 | A | 5/2013 | |
| CN | 203302510 | U | 11/2013 | |
| CN | 107920635 | A | 4/2018 | |
| CN | 208096372 | U | 11/2018 | |
| DE | 9412060 | U1 | 9/1994 | |
| DE | 29518585 | U1 | 1/1996 | |
| DE | 10315422 | A1 | 11/2004 | |
| DE | 202008004038 | U1 | 7/2009 | |
| FR | 2808171 | A1 | 11/2001 | |
| JP | 2004041474 | A | 2/2004 | |
| JP | 2004-082567 | A | 3/2004 | |
| JP | 200983706 | A | 4/2009 | |
| JP | 201137416 | A | 2/2011 | |
| JP | 2013-006027 | A | 1/2013 | |
| KR | 101015156 | B1 | 2/2011 | |
| KR | 101587773 | B1 | 1/2016 | |
| WO | 2007095633 | A2 | 8/2007 | |
| WO | WO-2007095633 | A2 * | 8/2007 | A45C 13/1069 |
| WO | 2013072312 | A1 | 5/2013 | |
| WO | 2014147130 | A1 | 9/2014 | |

OTHER PUBLICATIONS

Amazon, "Tumi Tegra-Lite X Frame Large Trip Packing Case", Accessed Sep. 7, 2017, First for sale on amazon date May 6, 2016. (https://www.amazon.com/Tumi-Tegra-Lite-Frame-Packing-Graphite/dp/B01E6VZRR4).

Youtube, "Tumi Alpha 2 International Carry-On Features" published by user Abt Electronics on Nov. 18, 2014, Accessed Sep. 7, 2017. (https://www.youtube.com/watch?v=0Sd3nVB_Rzg).

Etsy, "Vintage Brass Gold Trunk Hollywood Regency Eclectic Highly Reflective Bohemian Metal Footlocker" Sold by studio180, Vintage item from 1970s, Accessed Sep. 8, 2017. (https://www.etsy.com/listing/159762016/vintage-brass-gold-trunkhollywood? show_sold_out_detail=1).

Etsy, "Chief Vintage Tweed Steamer Trunk by Oshkosh" sold by ConceptFurnishings, Vintage item from 1930s, Accessed Sep. 8, 2017. (https ://www.etsy.com/listing/63703470/chief-vintage-tweed-steamer-trunk-by?showsold_ out_detail=1).

Luxury Trump, "Gucci Luxury Leather Trunks Arrive With A Hefty Price Tag Of $50,000", Posted May 25, 2014, Accessed Sep. 8, 2017. (http://luxurytrump.com/other/gucci-luxury-leather-trunks-50000/).

Amazon, "Tumi Alpha Wheeled 26" Expandable Medium Trip . . . ", First reviewed Sep. 20, 2012. (https://www.amazon.com/Alpha-Wheeled-Expandable-Medi um-022026DH/dp/B001XCX6ZA) (Year: 2012).

Amazon, "TUMI—Alpha 3 International Expandable 2 Wheeled Carry-on Luggage—22 Inch Rolling Suitcase for Men and Women—Black", First reviewed Jun. 21, 2019. (https://www.amazon.com/TU M I-International-Expandable-Carry-Suitcase/dp/B07MCTL3CU) (Year: 2019).

One Mile at a Time Blog, "Spinner Luggage: Pros And Cons", Posted Mar. 10, 2014. (https://onemileatatime.com/spinner-suitcases-one-hates/) (Year: 2014).

Office Action from corresponding Chinese Application No. 201480061754.6 dated Sep. 28, 2016.

Office Action from corresponding European Application No. 14816017.9 dated Jan. 16, 2018.

Summons to Attend Oral Proceedings from corresponding European Application No. 14816017.9 dated Nov. 8, 2018.

Notice of Reasons for Rejection in application No. JP 2016-529927 dated Nov. 20, 2018.

Tumi International, "International Expandable 4 Wheeled Carry-On", First reviewed Feb. 7, 2020. (https://www.tumi.conrilp/international -expandable-4-wheeled-carry-on-0124842T484/) (Year: 2020).

(56) References Cited

OTHER PUBLICATIONS

Tumi International, "Short Trip Expandable 4 Wheeled Packing Case", Accessed Feb. 18, 2021. (https://www.tumi.com/p/short-trip-expandable-4-wheeled -packing -case-01248441060/) (Year: 2021).
"Alpha Bravo-Henderson Wheeled Short Trip Packing Case", screenshot of Nordstrom.com.
"TUMI Celebrates Lexus' 25th Anniversary Crafted Line Autos With Exclusive Luggage Set", screenshot of JustLuxe.com.
International Search Report and the Written Opinion of the International Searching Authority from corresponding PCT/US2016/040697 dated Sep. 9, 2016.
Extended European Search Report in application No. PCT/US2016/040697 dated Jan. 28, 2019.
Amazon, "Tumi Arrive Alexandria Expandable Long Trip Packing Case, 225064D2," Accessed Oct. 26, 2017, First for sale on amazon Apr. 29, 2017. (https://www.amazon.com/Tumi-Alexandria-Expandable-Packing-225064D2/dp/B071RQ53P5).
Tumi, "Extended Trip Expandable 4 Wheeled Packing Case", First review Dec. 13, 2020. (https://www.tumi.com/p/extended-trip-expandable-4-wheeled-packing-case-0 1305951041 /) (Year: 2020).
International Search Report and the Written Opinion of the International Searching Authority from corresponding PCT/US2016/040714 dated Sep. 27, 2016.
Extended European Search Report in application No. PCT/US2016/040714 dated Feb. 5, 2019.
Notice on the First Office Action in application No. CN 201680039330.9 dated Jan. 9, 2019.
Office Action in corresponding Korean Patent Application No. 10-2017-7037585 dated Jul. 19, 2021.

* cited by examiner

ZIPPER COVER ARRANGEMENT FOR LUGGAGE AND BAGS

CROSS-REFERENCE TO RELATED APPLICATIONS

This application is a U.S. National Phase Application under 35 U.S.C. § 371 of International (PCT) Patent Application Serial No. PCT/US2019/012201 filed on Jan. 3, 2019, which is hereby incorporated herein by reference in its entirety for all purposes.

FIELD OF THE INVENTION

The present disclosure relates to a cover for a zippered closure for various shapes and sizes of soft shell luggage, hard shell luggage, and other bags. Other bags may include, for example, backpacks, briefcases, suitcases, tote bags, pocket books, purses, messenger bags, duffel bags, sports equipment bags, and the like.

BACKGROUND

Luggage items, and in particular luggage cases (suitcases), often include zippers for various purposes, including for use in opening and closing complimentary luggage shells, as well as for use in opening and closing pockets, among other uses. For some bags, the zipper pull-tabs of a zipper may be secured by a lock mechanism mounted on the luggage case to thwart unauthorized access. Where a user may desire to have frequent access to the interior of a pocket having a zippered opening, such as a zippered pocket, a user may prefer to leave the zippered opening unzipped or without locking the zipper. However, there is a problem with leaving zipper pull-tabs so that a zippered pocket is an open position and also with leaving the zipper pull-tabs exposed. By way of example, if the zipper is unzipped, the pocket is open, which can result in various issues such as items falling out, the teeth of the zipper or the zipper pull-tabs might be damaged by a foreign object, the teeth of the zipper or the zipper pull-tabs might damage the clothing of the user carrying the article of luggage, and the article of luggage can have a less desirable design aesthetic. Additionally, a user may not have the dexterity required for frequently manipulating the zipper pull-tab(s) to open and close the zippered opening to access the pocket.

Documents that may be related to the present disclosure include:

U.S. Pat. No. 4,397,378 is directed to a luggage zipper protector. A flap can be secured by snap fastener elements to protect and cushion the lower corner area of the zipper from damage.

U.S. Pat. No. 6,431,334 is directed to a travel bag with protected zippers. A covering is positioned at any location along the track of the zipper. The covering folds over the zipper towards the case. In the preferred embodiment, the covering is adapted to mate with and be removably secured to the adjacent surface of the case. The attachment means is described as preferably being a hook and pile closure. The covering has an axial length with respect to the zipper sufficient to cover the closure hardware and lock.

SUMMARY OF THE INVENTION

It is desirable to provide an improved zippered closure for an article of luggage, and more specifically an improved closure arrangement for a zippered opening that addresses the above-described problems, and/or which more generally offers improvements or an alternative to existing arrangements.

An aspect of this disclosure is directed to an article having a zipper tape secured at a mouth of a zippered opening in a surface of the article. The article includes a zipper cover constructed and arranged so as to conceal the zipper tape and to longitudinally extend substantially parallel to a length of the zipper tape. The zipper cover is attached to the surface of the article and is constructed and arranged so as to be rotatable between a first orientation and a second orientation. The zipper cover extends over the zipper tape to conceal the zipper tape when in the first orientation, and the zipper cover exposes the zipper tape and allows a user to access the zippered opening when in the second orientation. The article and zipper cover are constructed and arranged so that the zipper cover is magnetically securable to a surface of the zippered opening in the first orientation, and so that the zipper cover is magnetically securable against the surface of the article in the second orientation.

In some embodiments, the zipper cover includes at least one second magnet that is configured to interact with a magnetic zipper or at least one first magnet in the article.

In some embodiments, the surface of the zippered opening includes the first magnet(s), and the first magnet(s) is/are configured to interact with the second magnet(s) to magnetically secure the zipper cover in the first orientation.

In some embodiments, the surface of the article includes at least one third magnet. The third magnet(s) is/are configured to interact with the second magnet(s) to magnetically secure the zipper cover in the second orientation.

In some embodiments, the zipper cover has a length that is either substantially the same as the length of the zipper tape or greater than the length of the zipper tape.

In some embodiments, when the zipper cover is in the first orientation, if the zippered opening is in an unzipped condition, the zipper cover is constructed and arranged to hold the mouth of the zippered opening closed along the length of the zipper tape.

In some embodiments, the zipper cover has a thickness and shape so that an outer surface of the zipper cover is substantially flush with the surface of the article when the zipper cover is in the first orientation.

In some embodiments, the zipper cover has a first side and a second side opposite the first side. The first side of the zipper cover is in adjacent facing relation with the surface of the article when the zipper cover is in the second orientation, and the second side of the zipper cover is in facing relation with a surface of the zipper tape when the zipper cover is in the first orientation.

In some embodiments, the zipper cover has a height that is sufficient to conceal the zipper tape when the zipper cover is in the first orientation.

In some embodiments, the zipper tape extends along its length at least substantially perpendicularly to a height direction of the article, and the zipper cover is secured adjacent one of an upper longitudinal edge of the zipper tape and a lower longitudinal edge of the zipper tape.

In some embodiments, the zipper cover preferably comprises at least one of leather and plastic.

In some embodiments, the article further includes at least one zipper slider coupled to the zipper tape; and at least one zipper pull-tab, each zipper pull-tab coupled to a respective zipper slider of the at least one zipper slider. The zipper cover is configured to cover the zipper slider(s) and the zipper pull-tab(s) when the zipper cover is in the first orientation.

In some embodiments, the article is preferably one of a suitcase and a briefcase.

In some embodiments, the surface of the article is preferably one of a front face and a rear face of the article.

In some embodiments, the zipper cover is connected to the article by a hinge type connection that allows the zipper cover to rotate between the first orientation and the second orientation.

In some embodiments, the zipper cover is integrally formed with the article.

Another aspect of the present disclosure is directed to a method of selectively covering a zipper tape secured at a mouth of a zippered opening in a surface of an article of luggage. The method includes magnetically securing a zipper cover to a surface of the zippered opening in a first orientation and magnetically securing the zipper cover to the surface of the article of luggage in a second orientation with respect to the article of luggage, so that the zipper cover extends over the zipper tape when the zipper cover is in the first orientation, and so that the zipper cover exposes the zipper tape and allows access to the zippered opening when the zipper cover is in the second orientation.

In some embodiments, the method further includes providing the surface of the zippered opening with at least one first magnet, providing the zipper cover with at least one second magnet, and configuring the first magnet(s) to interact with the second magnet(s) to magnetically secure the zipper cover in the first orientation.

In some embodiments, the method includes providing the surface of the article of luggage with at least one third magnet, and configuring the third magnet(s) to interact with the second magnet(s) to magnetically secure the zipper cover in the second orientation.

In some embodiments, the method includes securing the zipper cover adjacent one of an upper longitudinal edge of the zipper tape and a lower longitudinal edge of the zipper tape.

In some embodiments, the method includes, when the zipper cover is in the first orientation, if the zippered opening is in an unzipped condition, holding the mouth of the zippered opening closed along a length of the zipper tape with the zipper cover.

In some embodiments, the method includes entirely covering the zipper tape with the zipper cover when the zipper cover is in the first orientation.

In some embodiments, the method includes entirely covering at least one zipper slider coupled to the zipper tape and entirely covering at least one zipper pull-tab coupled to the at least one zipper slider when the zipper cover is in the first orientation.

BRIEF DESCRIPTION OF THE DRAWINGS

Various aspects of at least one embodiment are discussed below with reference to the accompanying figures. The figures are provided for the purposes of illustration and explanation and are not intended as a definition of the limits of the invention. In the figures.

LIST OF REFERENCE NUMERALS UTILIZED IN THE DRAWINGS

Figure 1:
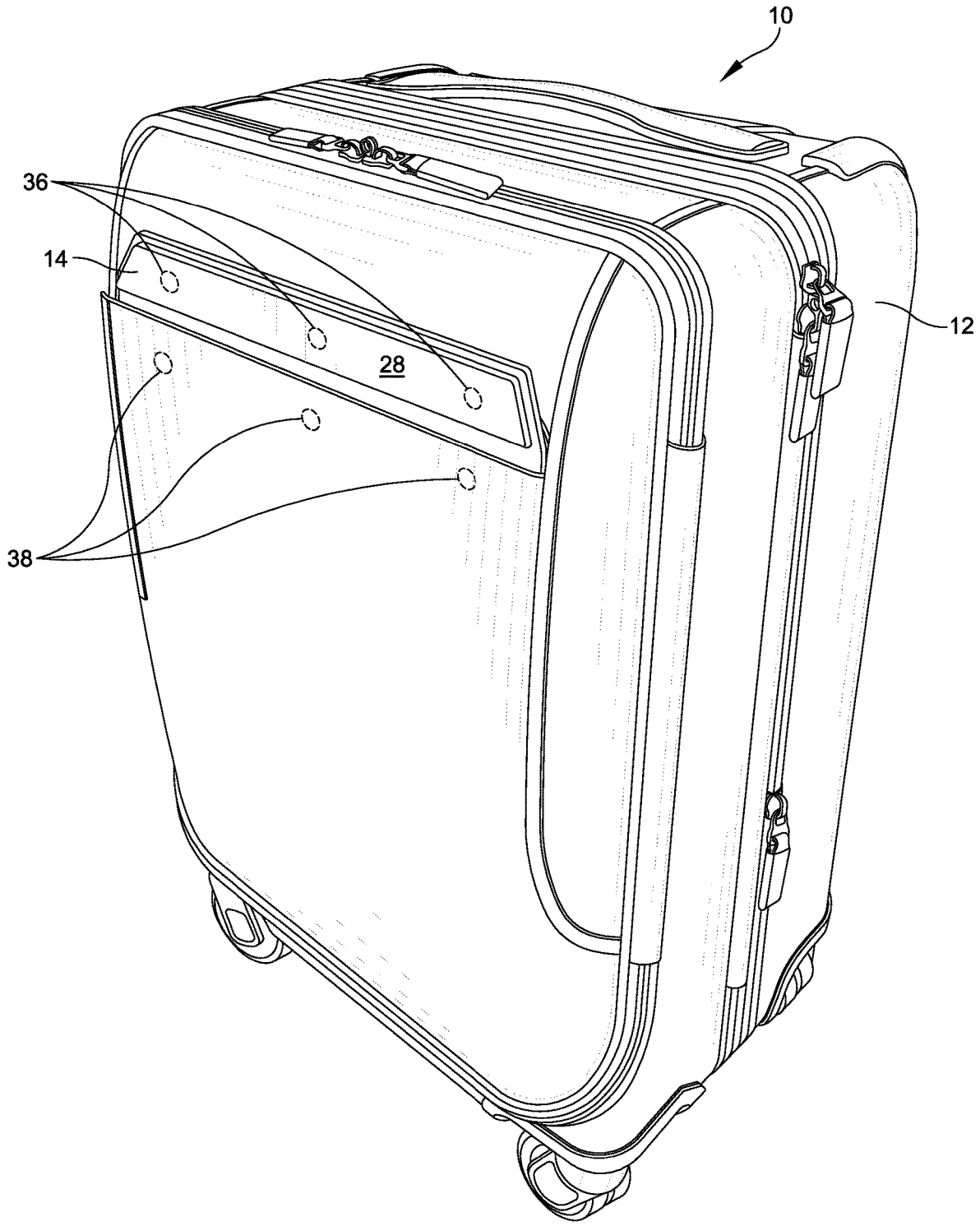
FIG. 1 is a perspective view of an article of luggage including a zipper cover according to the present disclosure in a first orientation.

With regard to reference numerals used, the following numbering is used throughout the description and drawings. Where technical features in the figures or detailed description are followed by these reference numerals, the reference numerals have been included for the sole purpose of increasing the intelligibility of the figures or detailed description. Accordingly, neither the reference numerals nor their absence is intended to have any limiting effect on the scope of any claim elements. In the figures, each identical or nearly identical component that is illustrated in various figures is represented by a like numeral. For purposes of clarity, not every component may be labeled in every figure.

Reference numeral 10 refers to an article of luggage.

Reference numeral 12 refers to a body of the article of luggage.

Reference numeral 14 refers to a zipper cover.

Reference numeral 16 refers to a zippered opening.

Reference numeral 18 refers to a zipper tape.

Reference numeral 20 refers to a front surface of the article of luggage 10.

Reference numeral 22 refers to a zipper slider.

Reference numeral 24 refers to a zipper pull-tab.

Reference numeral 26 refers to a longitudinal edge of the zipper tape 18.

Reference numeral 27 refers to a longitudinal edge of the zipper tape 18.

Reference numeral 28 refers to a first side of the zipper cover 14.

Reference numeral 30 refers to a second side of the zipper cover 14.

Reference numeral 32 refers to a surface of the zipper tape 18.

Reference numeral 34 refers to one or more first magnets.

Reference numeral 36 refers to one or more second magnets.

Reference numeral 38 refers to one or more third magnets.

Reference $L_1$ refers to a length of the zipper tape 18.

Reference $L_2$ refers to a length of the zipper cover 14.

Reference $H_1$ refers to a height of the zipper cover 14.

Reference $H_2$ refers to a height of the luggage 10.

Reference numeral 110 refers to an article of luggage.

Reference numeral 112 refers to a body of the article of luggage 110.

Reference numeral 114 refers to a zipper cover.

Reference numeral 116 refers to a zippered opening.

Reference numeral 118 refers to a zipper tape.

Reference numeral 120 refers to a front surface of the article of luggage 10.

Reference numeral 122 refers to a zipper slider.

Reference numeral 124 refers to a zipper pull-tab.

Reference numeral 128 refers to a first side of the zipper cover 114.

Reference numeral 130 refers to a second side of the zipper cover 114.

Reference numeral 132 refers to a surface of the zipper tape 118.

Reference numeral 134 refers to one or more first magnets.

Reference numeral 136 refers to one or more second magnets.

Reference numeral 138 refers to one or more third magnets.

DETAILED DESCRIPTION

Reference will now be made in detail to representative embodiments illustrated in the accompanying drawings. It should be understood that the following descriptions are not intended to limit the embodiments to one preferred embodiment. To the contrary, they are intended to cover alternatives, modifications, and equivalents as may be included within the spirit and scope of the described embodiments as defined by the appended claims.

The present disclosure relates to a zipper cover arrangement or a means for concealing a zipper tape for a zippered closure for various shapes and sizes of soft shell luggage, hard shell luggage, and other bags. Other bags may include, for example, backpacks, briefcases, suitcases, tote bags, pocket books, purses, messenger bags, duffel bags, sports equipment bags, and the like. The zipper cover is for an article of luggage or bag having a zipper tape secured at a mouth of a zippered opening in a surface of the article of luggage or bag and covers and conceals the zipper tape and zippered opening and extends substantially parallel to a length of the zipper tape and zippered opening. The zipper cover can be attached to the surface of the article of luggage and constructed and arranged so as to be rotatable between a first orientation and a second orientation, the zipper cover extending over the zipper tape and zippered opening to conceal the zipper tape and zippered opening when in the first orientation, and the zipper cover exposing the zipper tape and zippered opening and allowing a user to access the zippered opening when in the second orientation. The zipper cover and the article of luggage are constructed and arranged with magnets so that the zipper cover is magnetically securable to a surface of the zippered opening in the first orientation and so that the zipper cover is magnetically securable against the surface of the article in the second orientation.

Figure 2:
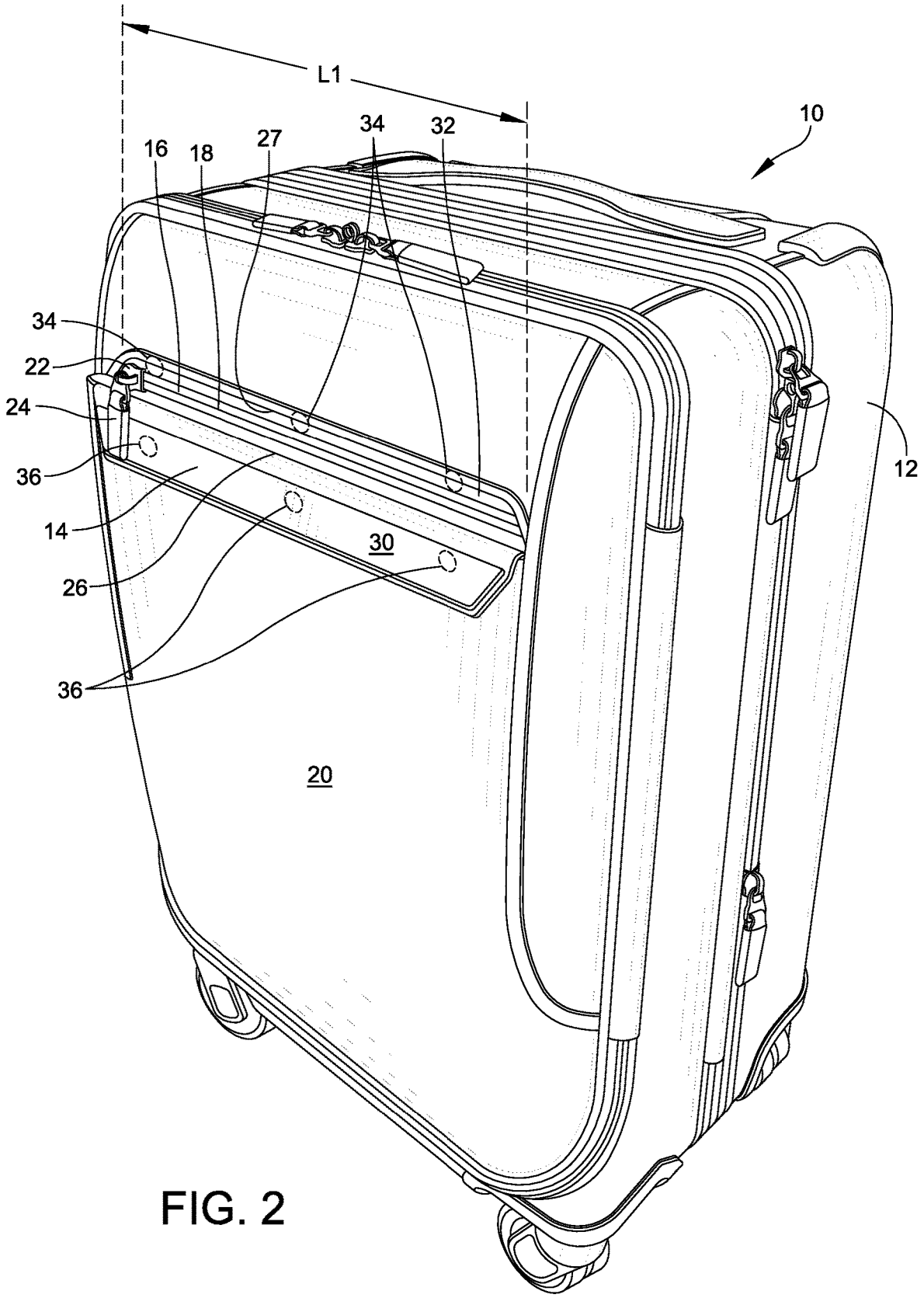
FIG. 2 is a perspective view of the article of luggage of FIG. 1 with the zipper cover in a second orientation.

For the purpose of explanation and illustration, and not limitation, FIG. 1 shows a perspective view of an article of luggage 10. A body 12 of the article of luggage 10 includes a zipper cover 14. The zipper cover 14 is secured to the article at a mouth of a zippered opening 16 (See FIG. 2) in a surface of the article of luggage 10. With reference to FIG. 2, the article of luggage is a suitcase that includes a zipper tape 18. The zipper tape 18 extends along a front surface 20 of the suitcase in a direction substantially perpendicular to a height direction $H_1$ of the article of luggage 10. A user can move a zipper slider 22 to open or close the zippered opening 16. The zipper slider 22 is coupled to the zipper tape 18, and a zipper pull-tab 24 is coupled to the zipper slider 22.

The zipper cover 14 extends substantially parallel to a length $L_1$ of the zipper tape 18. The zipper cover 14 is attached to the surface 20 of the article of luggage 10 and is constructed and arranged so as to be movable between a first orientation and a second orientation. The zipper cover 14 extends over the zipper tape 18, the zipper slider 22, and the zipper pull-tab 24 to conceal the zipper tape 18, the zipper slider 22, and the zipper pull-tab 24 when the zipper cover 14 is in the first orientation, as shown in FIG. 1. The zipper cover 14 exposes the zipper tape 18, the zipper slider 22, and the zipper pull-tab 24 and allows a user to access the zippered opening when the zipper cover 14 is in the second orientation, as shown in FIG. 2. Thus, when the user wishes to access the zippered opening 16, the user may rotate the zipper cover to the second orientation.

Referring to FIG. 1, according to aspects of this embodiment the zipper cover is located on a front surface 20 of the body 12 of the suitcase. In the embodiment of FIG. 1, the zipper cover is secured adjacent a lower longitudinal edge 26 of the zipper tape 18 (See FIG. 2). In some embodiments, the zipper cover may be secured adjacent an upper longitudinal edge 27 of the zipper tape 18.

The zipper cover has a first side 28 and a second side 30 (See FIG. 2) opposite the first side. The second side 30 of the zipper cover is in facing relation with a surface 32 of the zipper tape 18 when the zipper cover is in the first orientation, as shown in FIG. 1. The first side 28 of the zipper cover is in adjacent facing relation with the surface 20 of the article of luggage 10 when the zipper cover is in the second orientation, as shown in FIG. 2.

Figure 3:
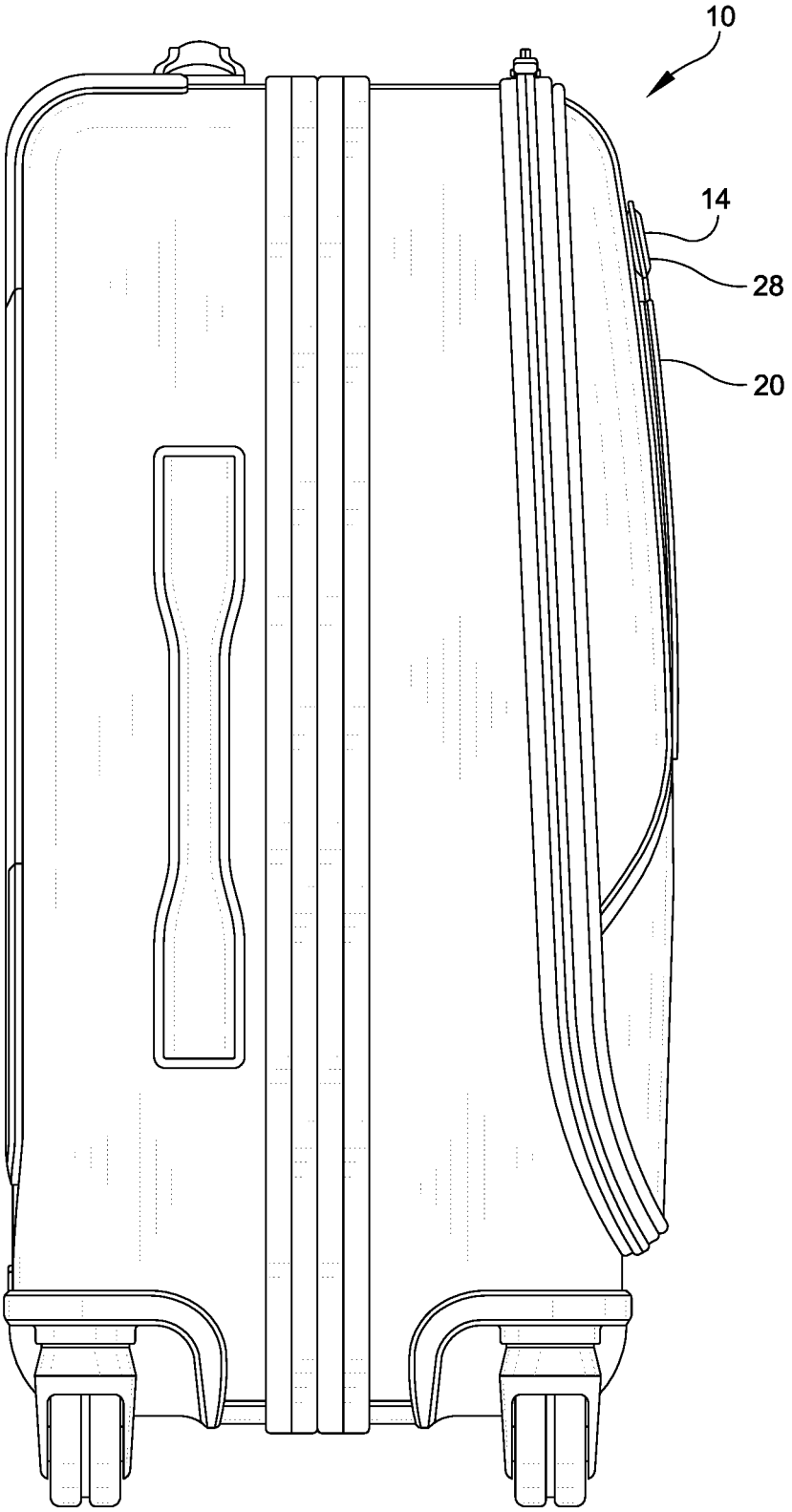
FIG. 3 is a side view of the article of luggage of FIG. 1.

FIG. 3 is a side view of the article of luggage of FIG. 1, showing the zipper cover 14 in the first orientation. The zipper cover has a thickness and shape so that the first side 28 of the zipper cover is substantially flush with the surface 20 of the article of luggage 10 when the zipper cover is in the first orientation.

Referring to FIG. 2, with this arrangement, when the zipper cover is in the second orientation, the second side 30 of the zipper cover extends beyond the front surface 20 of the article of luggage by the thickness of the zipper cover.

Figure 4:
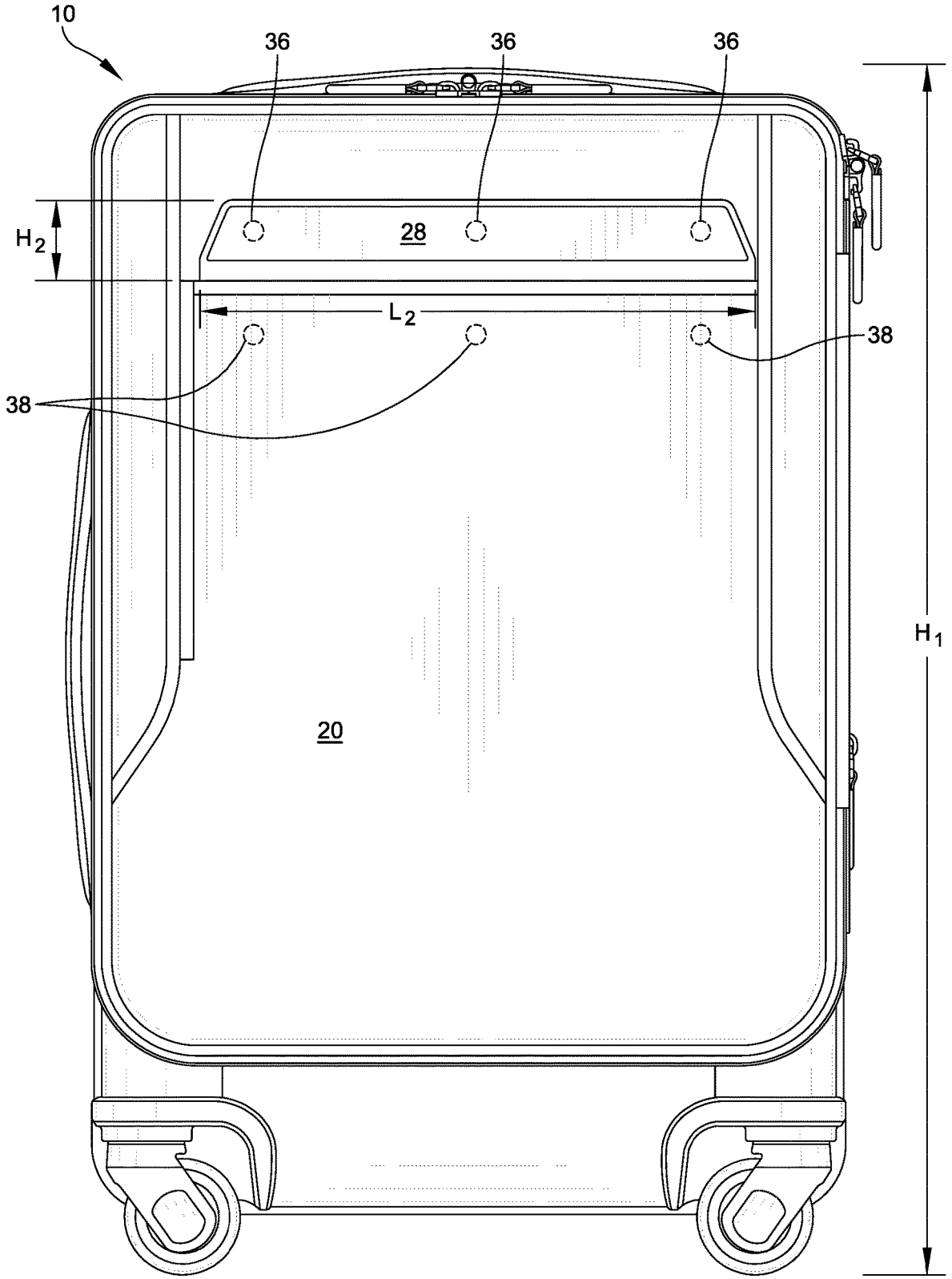
FIG. 4 is a front view of the article of luggage of FIG. 1.

Referring to FIG. 4, the length $L_2$ and the height $H_2$ of the zipper cover are selected such that the zipper cover covers the zipper tape 18 when the zipper cover is in the first orientation as shown in FIG. 1. In particular, as illustrated in FIG. 4, the zipper cover has a height $H_2$ that is sufficient to conceal the zipper tape 18 when the zipper cover is in the first orientation and the zipper cover has a length $L_2$ that is substantially the same as the length $L_1$ of the zipper tape 18. In other embodiments, the zipper cover has a length $L_2$ that is greater than the length $L_1$ of the zipper tape 18. It is appreciated that the zipper cover can be of any length.

In an embodiment of the luggage and zipper cover, the zipper cover has a length $L_2$ that is shorter than the length $L_1$ of the zipper tape. In this embodiment, the zipper tape has a length of about 34.5 centimeters, the zipper cover has a length that is between about 29.5 centimeters and about 32.0 centimeters, and the zipper cover has a height of about 3 centimeters.

The article of luggage and the zipper cover are constructed and arranged so that the zipper cover is magnetically securable to a surface of the zippered opening in the first orientation, and so that the zipper cover is magnetically securable against the surface of the article in the second orientation. For example, in the arrangement of the embodiment of FIG. 1, the surface 32 of the zipper tape includes a plurality of first magnets 34. The first magnets 34 may be secured within a material of the zipper tape, on a surface of the zipper tape, or behind the zipper tape. The zipper cover includes a plurality of second magnets 36, which may be secured on a surface of the zipper cover or within the zipper cover. Alternatively, the zipper tape itself can be metal such that the zipper tape itself attracts the plurality of second magnets of the zipper cover. In some embodiments, the zipper tape itself can be magnetic such that the zipper tape itself attracts the plurality of second magnets of the zipper cover. The surface 20 of the article of luggage 10 may also include a plurality of third magnets 38, which may be secured on a surface of the article of luggage or within the article of luggage. The first magnets 34 are configured to interact with the second magnets 36 to magnetically secure the zipper cover in the first orientation. The third magnets 38 are configured to interact with the second magnets 36 to magnetically secure the zipper cover in the second orientation.

Although the embodiment of FIGS. 1-5 is shown as having three first magnets, three second magnets, and three third magnets, it is to be appreciated that any number, size and type of magnets may be provided so long as the size and arrangement of the magnets keep the second side 30 of the zipper cover magnetically attracted to a surface 32 of the zipper tape 18 when the zipper cover is in the first orientation and keep the first side 28 of the zipper cover is in adjacent facing relation with the surface 20 of the article of luggage 10 in the second orientation. For example, some embodiments may include one or more first magnet, one or more second magnet, and one or more third magnet.

In a preferred embodiment of the luggage and zipper cover, the number of first magnets is two, the number of second magnets is two, and the number of third magnets is two. In this embodiment, the two second magnets are rectangular in shape and each magnet is disposed near a longitudinal end of the zipper cover. For this embodiment, the first magnets and third magnets are also rectangular in shape and positioned at the zipper tape surface and the surface of the article of luggage to respectively align with the second magnets.

It is appreciated that the first magnet(s), second magnet(s), and third magnet(s) may be of any shape, such as circular, rectangular, square, or another shape.

Figure 5:
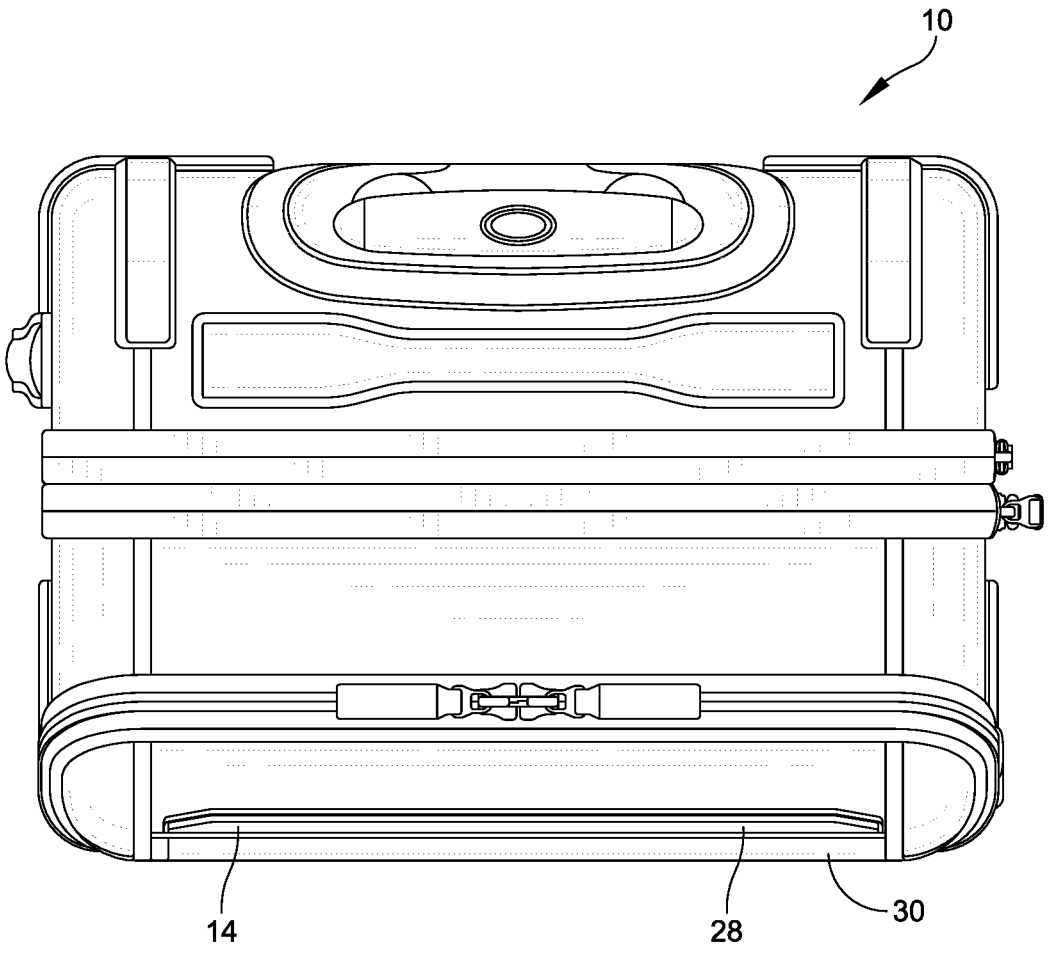
FIG. 5 is a top view of the article of luggage of FIG. 1.

FIG. 5 is a top view of the article of luggage of FIGS. 1-4. The top view of FIG. 5 shows how the zipper cover is retained in the first orientation, so the first side 28 of the zipper cover is substantially flush with the surface 20 of the article of luggage 10.

One advantage of the zipper cover is that the user may close the zippered opening 16 without the zipper tape being in a closed position by moving the zipper cover to the first orientation. The user does not need to move the zipper slider 22 to a closed position along the zipper tape 18. In particular, with this arrangement the zipper cover is magnetically secured in the first orientation, and the zipper cover holds the mouth of the zippered opening 16 closed along the length $L_1$ of the zipper tape 18, even if the zippered opening is in an unzipped condition.

It is to be appreciated that the zipper cover arrangement according to the present disclosure may be provided on other articles of luggage. FIGS. 6-10 show another example of an article of luggage that is a briefcase 110. All of the above noted structure, features and advantages of the zipper cover arrangement for the article of luggage shown in FIGS. 1-5 also apply to this embodiment of a briefcase, and the description is not fully repeated here for the sake of brevity According to this embodiment, a body 112 of the briefcase 110 includes a zipper cover 114. The zipper cover 114 is secured at a mouth of a zippered opening 116 (See FIG. 7) in a surface of the briefcase 110. Referring to FIG. 7, the briefcase includes a zipper tape 118. The zipper tape 118 extends along a rear surface 120 of the briefcase in a direction substantially perpendicular to a height direction of the briefcase 110. A user can move a zipper slider 122 to open or close the zippered opening 116. The zipper slider 122 is coupled to the zipper tape 118, and a zipper pull-tab 124 is coupled to the zipper slider 122.

Figure 6:
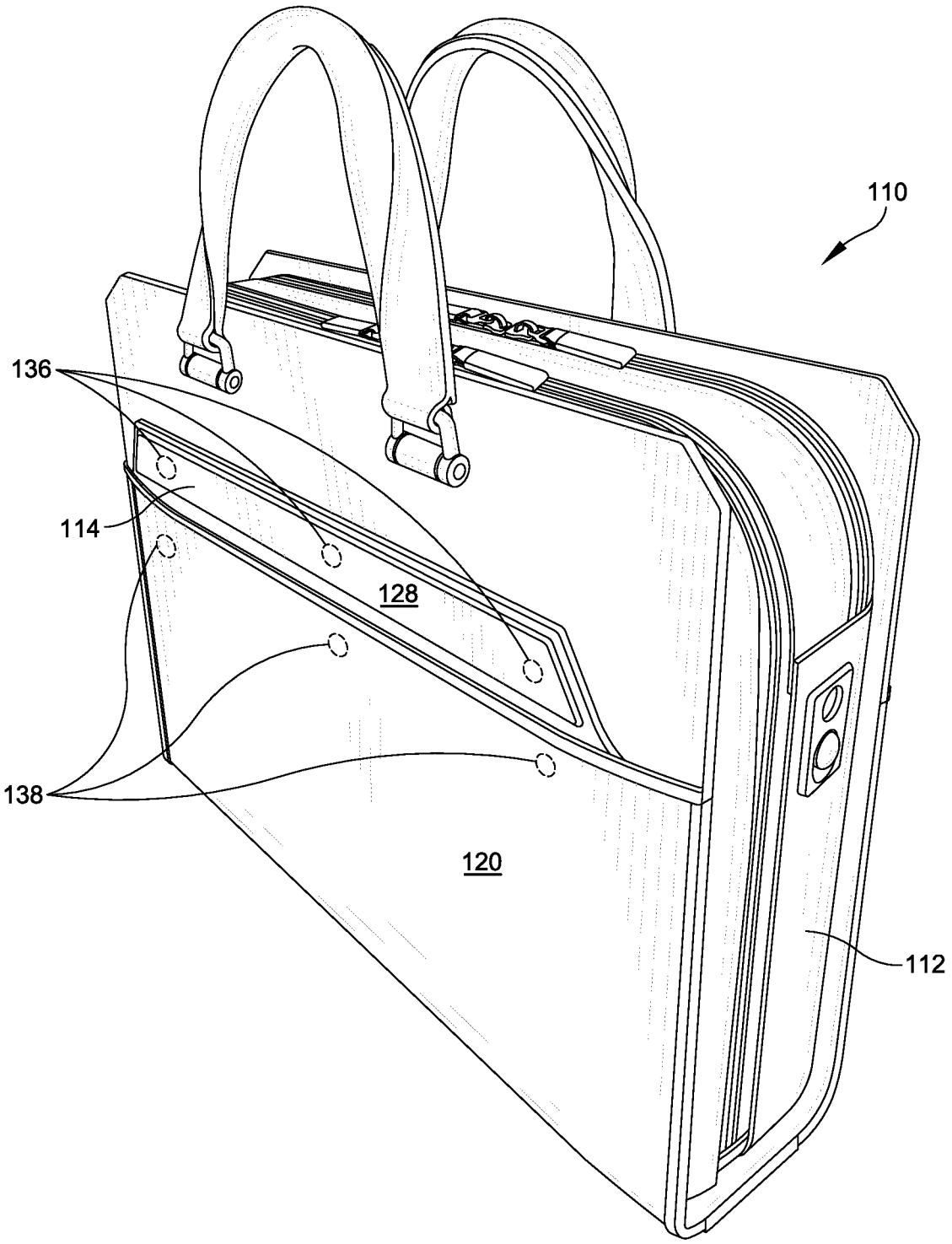
FIG. 6 is a perspective view of an article of luggage including a zipper cover according to the present disclosure in a first orientation.
Figure 7:
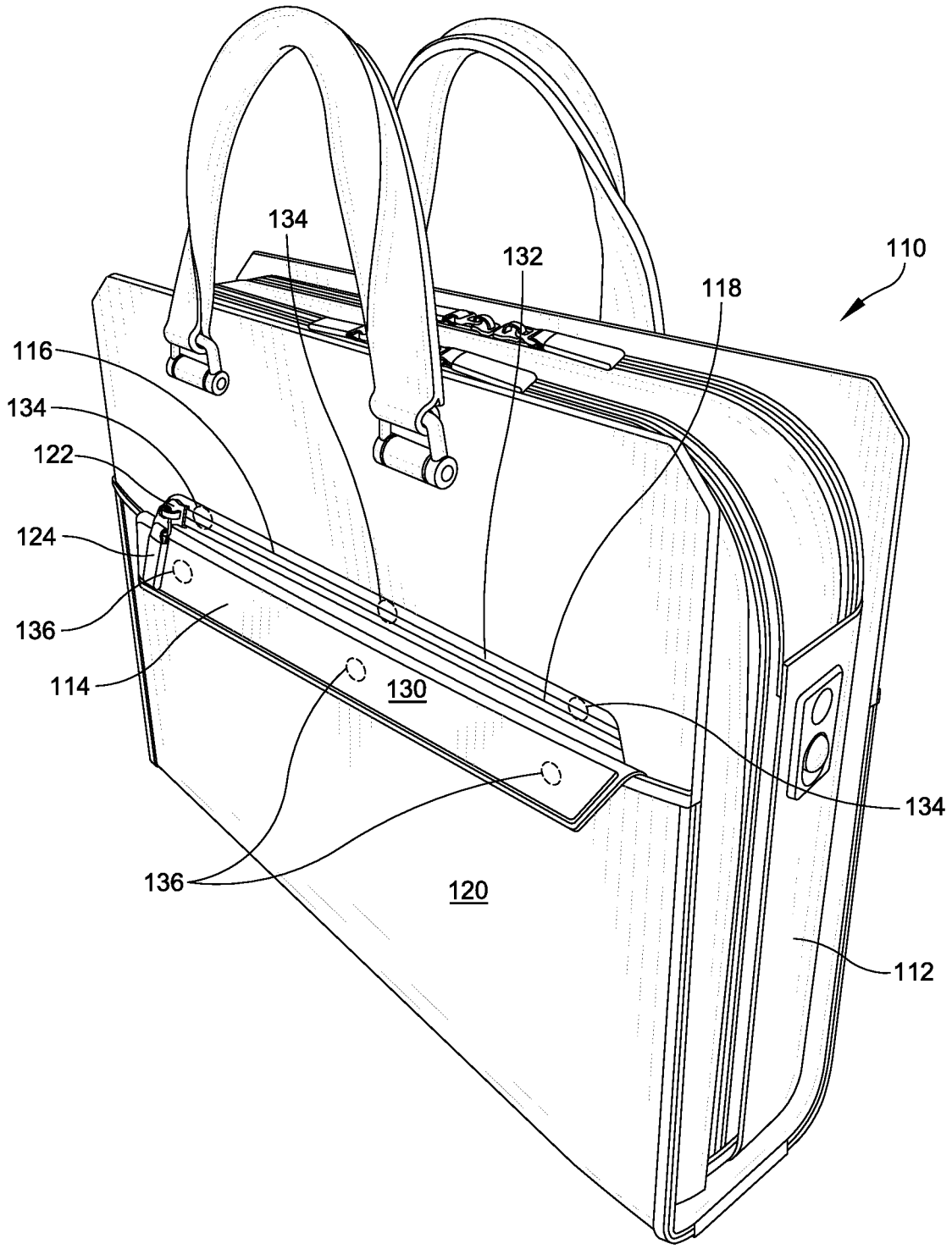
FIG. 7 is a perspective view of the article of luggage of FIG. 6 with the zipper cover in a second orientation.
Figure 8:
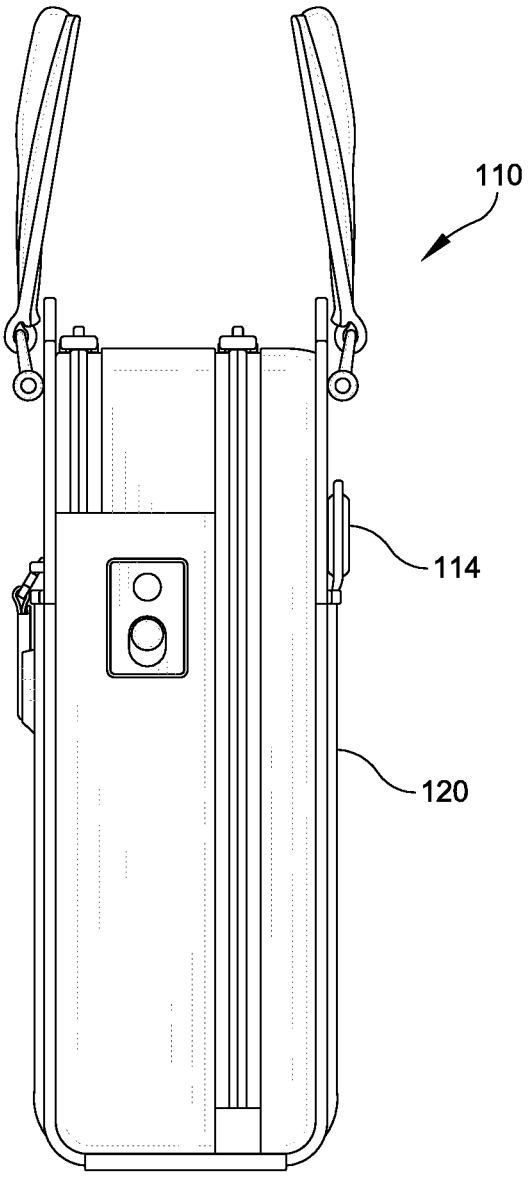
FIG. 8 is a side view of the article of luggage of FIG. 6.
Figure 9:
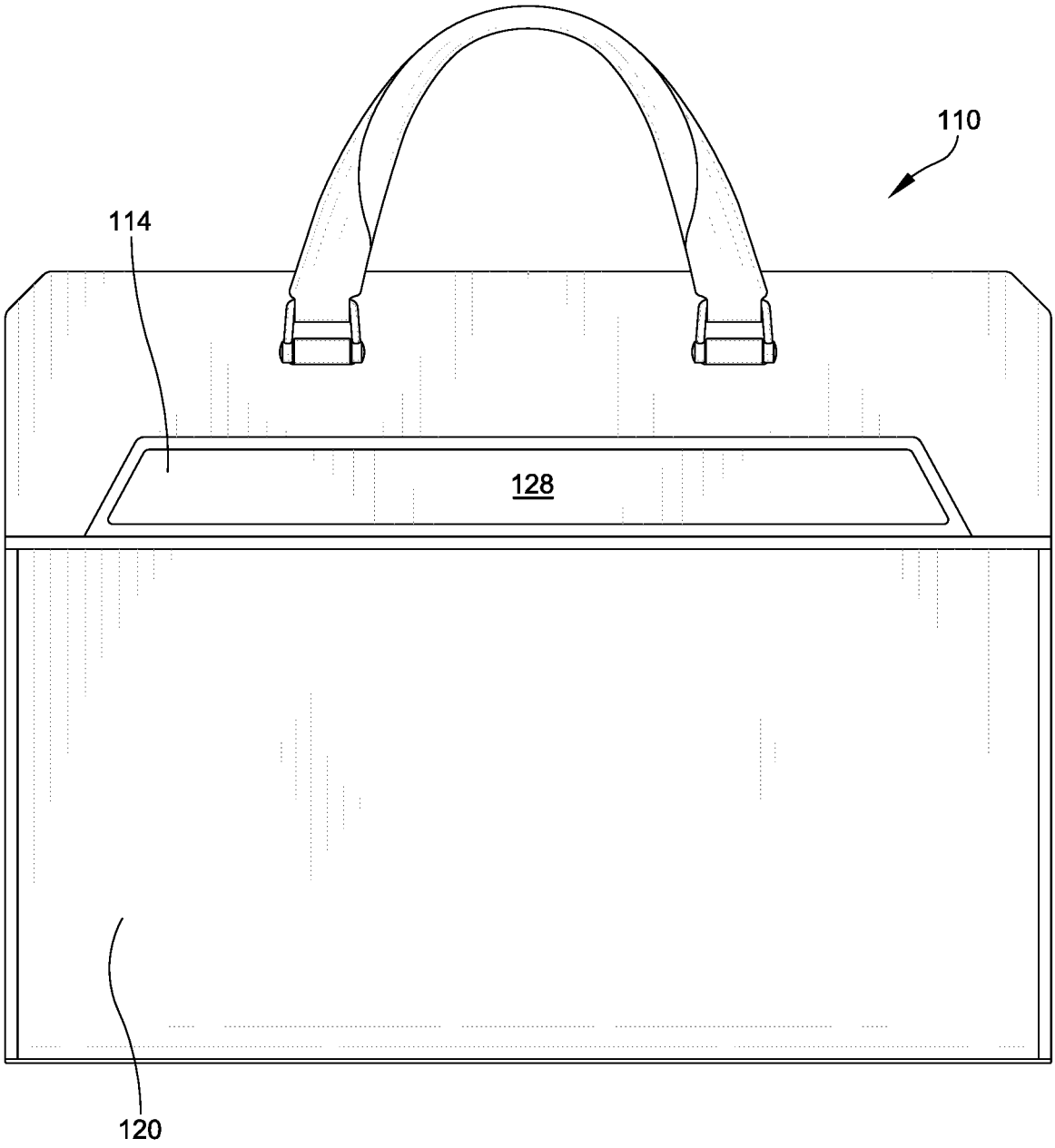
FIG. 9 is a front view of the article of luggage of FIG. 6.
Figure 10:
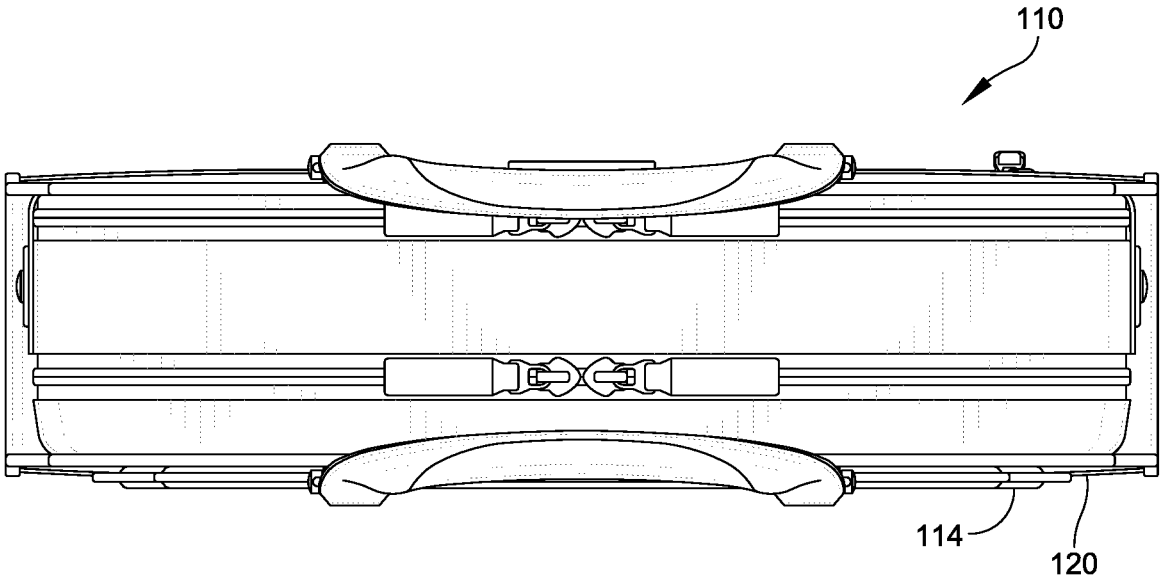
FIG. 10 is a top view of the article of luggage of FIG. 6.

For this embodiment of FIGS. 6-10, like the embodiments of FIGS. 1-5, the zipper cover 114 is attached to the surface 120 of the article of luggage 110 and is constructed and arranged so as to be movable between a first orientation and a second orientation. The zipper cover 114 extends over the zipper tape 118, the zipper slider 122, and the zipper pull-tab 124 to conceal the zipper tape 118, the zipper slider 122, and the zipper pull-tab 124 when the zipper cover 114 is in the first orientation, as shown in FIG. 6. The zipper cover 114 exposes the zipper tape 118, the zipper slider 122, and the zipper pull-tab 124 and allows a user to access the zippered opening when the zipper cover 114 is in the second orientation, as shown in FIG. 7. Thus, when the user wishes to access the zippered opening 116, the user may rotate the zipper cover to the second orientation.

For this embodiment, the zipper cover 114 is secured to the rear surface 120 of the briefcase, and the user may wish the zipper cover to be in the first orientation when a user carries the briefcase, so that the zipper cover 114 extends over the zipper tape 118 to protect the user's clothing from being damaged by the teeth of the zipper tape 118. It is appreciated that although the zipper cover is shown to cover a zipper tape, zipper slider and zipper pull on a rear surface of the briefcase, it can also be used to cover a zipper on any surface such as a front surface of the briefcase. For this embodiment, the zipper cover is secured adjacent a lower longitudinal edge of the zipper tape 118 (See FIG. 7). In some embodiments, the zipper cover may be secured adjacent an upper longitudinal edge of the zipper tape 118.

The zipper cover has a first side 128 and a second side 130 opposite the first side. The second side 130 of the zipper cover is in facing relation with a surface 132 of the zipper tape 118 when the zipper cover is in the first orientation, as shown in FIG. 6. The first side 128 of the zipper cover is in adjacent facing relation with the surface 120 of the briefcase 110 when the zipper cover is in the second orientation, as shown in FIG. 7.

For the embodiment, the surface 132 of the zipper tape can include a plurality of first magnets 134. The first magnets 134 may be secured within a material of the zipper tape, on a surface of the zipper tape, or behind the zipper tape. The zipper cover 114 can include a plurality of second magnets 136, which may be secured on a surface of the zipper cover 114 or within the zipper cover 114. The surface 120 of the article of luggage 110 can also include a plurality of third magnets 138, which may be secured on a surface of the article of luggage or within the article of luggage. The first magnets 134 are configured to interact with the second magnets 136 to magnetically secure the zipper cover in the first orientation. The third magnets 138 are configured to interact with the second magnets 136 to magnetically secure the zipper cover in the second orientation. With this arrangement, when the zipper cover 114 is retained in the first orientation, the first side 128 of the zipper cover 114 is substantially flush with the surface 120 of the article of luggage 110. Referring to FIG. 7, with this arrangement, when the zipper cover is in the second orientation, the second side 130 of the zipper cover extends beyond the front surface 120 of the article of luggage by the thickness of the zipper cover.

Although the embodiment of FIGS. 6-10 is shown as having three first magnets, three second magnets, and three third magnets, it is to be appreciated that any number of these magnets may be provided so long as the size and arrangement of the magnets keep the second side 130 of the zipper cover magnetically attracted to a surface 132 of the zipper tape 118 when the zipper cover is in the first orientation and keep the first side 128 of the zipper cover in adjacent facing relation with the surface 120 of the article of luggage 110 in the second orientation. For example, some embodiments may include one or more first magnet, one or more second magnet, and one or more third magnet.

In a preferred embodiment, the number of first magnets is two, the number of second magnets is two, and the number of third magnets is two. In this embodiment, the two second magnets are rectangular in shape and each magnet is disposed near a longitudinal end of the zipper cover. For this embodiment, the first magnets and third magnets are also rectangular in shape and positioned at the zipper surface and the surface of the briefcase to respectively align with the second magnets.

It is appreciated that the first magnet(s), second magnet(s), and third magnet(s) may be of any shape, such as circular, rectangular, square, or another shape.

In one embodiment, the briefcase 110 has an overall length of 40 centimeters, an overall height of 30 centimeters, and an overall depth of between about 6.5 centimeters and about 9 centimeters; the zipper tape 118 has a length of 34.5 centimeters; the zipper cover 114 has a height of 3 centimeters; and the zipper cover is secured adjacent a lower edge of the zipper tape, which is between about 7 centimeters and about 8.5 centimeters from an upper edge of the briefcase 110.

According to another aspect of the present disclosure, a method is provided for selectively covering a zipper tape secured at a mouth of a zippered opening in a surface of an article of luggage. The methods disclosed herein may be practiced with the structure of the present disclosure.

In some embodiments, the method includes magnetically attracting a zipper cover in one of a first orientation and a second orientation with respect to the article of luggage. A user can selectively position the zipper cover in the first orientation or the second orientation. The zipper cover extends over the zipper tape when the zipper cover is in the first orientation. The zipper cover exposes the zipper tape and allows a user to access the zippered opening when the zipper cover is in the second orientation.

In some embodiments, the method includes entirely covering the zipper tape with the zipper cover when the zipper cover is in the first orientation. This may be accomplished by dimensioning the zipper cover so that the length and the height of the zipper cover conceal the zipper tape from view of a person looking at the luggage surface on which the zipper tape is positioned.

In some embodiments, the method includes entirely covering at least one zipper slider coupled to the zipper tape and entirely covering at least one zipper pull-tab coupled to the at least one zipper slider when the zipper cover is in the first orientation.

According to one aspect of the present disclosure, a means for concealing a zipper for an article of luggage is provided. In some embodiments, the means for concealing the zipper tape is a zipper cover for covering a zippered closure. The zipper cover is connected to the surface of the article of luggage. For an article of luggage that has a zipper tape secured at a mouth of a zippered opening, the zipper cover extends at least substantially parallel to a length of the zipper tape. In some embodiments, the zipper cover may be connected to the article of luggage by a hinge type connection that allows the zipper cover to rotate between a first orientation and a second orientation. In some embodiments, the zipper cover may be integrally formed with the article of luggage. In some embodiments, the zipper cover may be secured to the article of luggage by stitching, adhesive, or another fastener.

The zipper cover is movable between the first orientation and the second orientation. The zipper cover extends over the zipper tape to conceal the zipper tape when the zipper cover is in the first orientation, and the zipper cover exposes the zipper tape and allows a user to access the zippered opening when the zipper cover is in the second orientation. A user can selectively rotate the zipper cover to the first orientation to cover the zippered opening or the second orientation to expose the zippered opening as desired by the user.

In some embodiments, the zipper cover at least substantially hides the zippered opening for a pocket or compartment on the article of luggage when the zipper cover is in the first orientation. In some embodiments, the zipper cover entirely hides the zippered opening for a pocket or compartment on an article of luggage when the zipper cover is in the first orientation.

In some embodiments, the zipper cover has a first side and a second side opposite the first side. The first side of the zipper cover is in adjacent facing relation with the surface of the article of luggage when the zipper cover is in the second orientation. The second side of the zipper cover is in facing relation with a surface of the zipper tape when the zipper cover is in the first orientation. In some embodiments, the first side of the zipper cover is substantially flush with the surface of the article of luggage when the zipper cover is in the first orientation. In some embodiments, the second side of the zipper cover is substantially flush with the surface of the article of luggage when the zipper cover is in the second orientation. This provides an improved aesthetic appearance of the article of luggage.

The zipper cover is magnetically securable to a surface of the zippered opening in the first orientation, and is magnetically securable against the surface of the article of luggage in the second orientation. In particular, the zipper cover is magnetically securable to the surface of the zippered opening in the first orientation and the surface of the luggage in the second orientation with one or more magnets provided in the zipper cover and on the body of the article of luggage. In some embodiments, the article of luggage includes at least one magnet, and the zipper cover includes at least one magnet. Each magnet of the zipper cover is configured to interact with one or more of the magnets of the article of luggage to magnetically secure the zipper cover in first orientation and/or the second orientation. The size and strength of the one or more magnet(s) should be of a size and magnitude to securely hold the zipper cover in the first and second orientations while also allowing for comfortable operation by a user. Individuals with limited finger dexterity may find it difficult to open locks, such as Transportation Security Administration (TSA) approved locks or other luggage locks. In some embodiments, the magnetic force that holds the zipper cover in the first and second orientations is such that a person with limited finger dexterity can easily disengage the zipper cover from the first or second orientation. An advantage of this arrangement is that a user does not need to move the zipper sliders to open and close the zippered opening.

In some embodiments, at least one zipper slider of the luggage is coupled to the zipper tape. In some embodiments, at least one zipper pull-tab is provided, with each zipper pull-tab coupled to a respective one of the zipper sliders. In some embodiments, the zipper cover covers the zipper tape and other structures of the zipper. In particular, the zipper cover is configured to cover the zipper slider(s) and the zipper pull-tab(s) when the zipper cover is in the first orientation. In some embodiments, the zipper cover is configured to conceal the zipper tape, the zipper slider(s), and the zipper pull-tab(s) positioned along the zipper tape. In some embodiments, the zipper cover is configured to entirely hide the zipper tape and any zipper pull tabs and zipper sliders positioned along the zipper tape when the zipper cover is in the first orientation. The length and/or height of the zipper cover may be selected to allow the zipper cover to entirely conceal the zipper tape or the zipper tape and the zipper pull tabs when the zipper cover is in the first orientation. In this way, the zipper cover maintains an improved aesthetic appearance of the luggage, and a cleaner arrangement of the zipper pull-tab(s) beneath the zipper cover.

In some embodiments, the zipper cover has a height that is sufficient to conceal the zipper tape when the zipper cover is in the first orientation. However, the zipper cover may be sufficiently short that a user can quickly rotate the zipper cover between the first orientation to the second orientation. The zipper cover may be sufficiently short that a surface of the zipper cover is flush with a first surface of an article of luggage when in the first orientation and is in contact with the first surface of the article of luggage when in the second orientation. In some embodiments, the zipper cover has a height of between 0.5 inch and 2.5 inches. In some embodiments, the zipper cover has a height of between 0.75 and 2.3 inches. In some embodiments, the zipper cover has a height of between 1.0 inch and 2.0 inches. In some embodiments, the zipper cover has a height of about 1 inch, about 1.2 inches, about 1.4 inches, about 1.6 inches, about 1.8 inches, or about 2.0 inches. In some embodiments, the zipper cover has a height of about 2.5 centimeters, about 2.6 centimeters, about 2.7 centimeters, about 2.8 centimeters, about 2.9 centimeters, about 3.0 centimeters, about 3.1 centimeters, about 3.2 centimeters, about 3.3 centimeters, about 3.4 centimeters, or about 3.5 centimeters. In a preferred embodiment, the height of the zipper cover is 3.0 centimeters.

In some embodiments, the zipper cover extends at least substantially perpendicularly to a height direction of the article of luggage. In such embodiments, the height of the zipper cover extends in the same direction as the direction of the height of the article of luggage. In some embodiments, the zipper cover extends in a direction that is parallel to or at a non-perpendicular angle with respect to the height direction of the article of luggage. As used herein, the "height" of the zipper cover is perpendicular to the length of the zipper cover, which extends substantially parallel to the length of the zipper tape.

In some embodiments, the zipper cover is secured adjacent to a longitudinal edge of the zipper tape. For example, when the zipper tape extends horizontally on a surface of an article of luggage, the zipper tape may be secured adjacent an upper longitudinal edge of the zipper tape or adjacent a lower longitudinal edge of the zipper tape.

In some embodiments, the zipper cover has a length that is substantially the same as the length of the zipper tape. In some embodiments, the zipper cover has a length that is greater than the length of the zipper tape. In embodiments in which the zipper cover has a length that is at least as great as the length of the zipper tape, the zipper cover entirely covers the zipper tape. By entirely covering the zipper tape, the zipper cover protects the zipper tape from damage that could be caused by foreign objects contacting the zipper tape and the zipper cover protects other objects from damage that could be caused by the zipper tape contacting the other objects. For example, the zipper cover prevents a foreign object from deforming or otherwise damaging the teeth of the zipper or the zipper pull-tabs. Additionally, the zipper cover prevents elements of the environment, such as rain, from entering an unzipped opening. Additionally, the zipper cover prevents the teeth of the zipper from catching on a user's clothes when the user is handling the article of luggage.

The zipper cover provides an alternative means of at least substantially closing a zippered opening without requiring movement of the zipper slider. In some embodiments, when the zippered opening is in an unzipped condition, the zipper cover holds the mouth of the zippered opening closed along the length of the zipper tape. This is accomplished, for example, by embodiments in which the length of the zipper cover is at least as long as the zipper tape. By holding the mouth of the zippered opening closed along the length of the zipper tape, the zipper cover serves as a security mechanism for the zippered opening. A user may choose to leave the zipper slider in an unzipped position, and simply rotate the zipper cover between the first and second orientations to open and close the zippered opening.

In some embodiments, the zipper cover holds the zipper pull tab against the zipper tape when the zipper cover is in the first orientation. This also improves the security of the zippered opening. Because the zipper cover holds the zipper pull tab against the zipper tape, it prevents a foreign object from catching on the zipper pull tab and pulling the zipper pull tab to an open position on the zipper tape. For example, the zipper cover also conceals the zipper pull tab, and the object would not come in direct contact with the zipper pull tab.

In some embodiments, when the zipper cover is in the first orientation, the zipper cover may hold the zip pull-tab against the zipper tape so that a longitudinal direction of the pull-tab extends parallel to the longitudinal direction of the zipper tape. In this way, the pull-tab is concealed by the zipper cover and does not extend outwardly beyond the zipper cover.

The zipper cover may be formed of various materials. For example, the zipper cover may be formed of one or more of leather, plastic, and/or other materials.

The zipper cover may be used with various articles of luggage. In some embodiments, the article of luggage is a suitcase or a briefcase.

The zipper cover may be used with a zippered opening that is on a surface of an article of luggage. In some embodiments, the surface of the article of luggage is a front surface of the article of luggage. In some embodiments, the surface of the article of luggage is a side surface of the article of luggage. In some embodiments, the surface of the article of luggage is a top surface of the article of luggage. In some embodiments, the surface of the article of luggage is a bottom surface of the article of luggage. In some embodiments, the surface of the article of luggage is a rear surface of the article of luggage. In some embodiments, the surface of the article of luggage is a rear surface of an article of luggage in the form of a briefcase.

It is to be appreciated that one advantage of the various embodiments of the zipper cover of the disclosure is that the user may close the zippered opening of the article by moving the zipper cover to the first orientation. Another advantage is that the user does not need to move the zipper slider to a closed position along the zipper tape. With this arrangement, the zipper cover is magnetically secured in the first orientation, and the zipper cover holds the mouth of the zippered opening closed along the length of the zipper tape, even if the zippered opening is in an unzipped condition.

Another advantage of the zipper cover is that it simpler/easier having the magnet zipper cover covering the zipper tape and zipper pull-tabs and zippered pocket.

Another advantage of the zipper cover is that it covers the zipper tape and zipper pull-tabs and also keeps them out of the way, and also of prevents (or at least restricts) the zipper tape, zipper sliders and zipper pull-tabs from being exposed and interacting with other objects in use.

Another advantage is that the zipper cover keeps the zipper pull-tabs and zippered pocket retained.

Another advantage is that the zipper cover maintains an improved aesthetic appearance of the luggage, and a cleaner arrangement of the zipper pull-tab(s) beneath the zipper cover.

According to an aspect of the present disclosure, there is provided an improved luggage article as described in the accompanying claims.

While the disclosed subject matter is described herein in terms of certain exemplary embodiments, those skilled in the art will recognize that various modifications and improvements can be made to the disclosed subject matter without departing from the scope thereof. As such, the particular features claimed below and disclosed above can be combined with each other in other manners within the scope of the disclosed subject matter such that the disclosed subject matter should be recognized as also specifically directed to other embodiments having any other possible permutations and combinations. It will be apparent to those skilled in the art that various modifications and variations can be made in the systems and methods of the disclosed subject matter without departing from the spirit or scope of the disclosed subject matter. Thus, it is intended that the disclosed subject matter include modifications and variations that are within the scope of the appended claims and their equivalents.

What is claimed:

1. An article having a zipper tape secured at a mouth of a zippered opening in a surface of the article, the article comprising a zipper cover constructed and arranged so as to conceal the zipper tape and to longitudinally extend substantially parallel to a length of the zipper tape, the zipper cover being attached to the surface of the article and being constructed and arranged so as to be rotatable between a first orientation and a second orientation, the zipper cover extending over the zipper tape to conceal the zipper tape when in the first orientation, and the zipper cover exposing the zipper tape and allowing a user to access the zippered opening when in the second orientation, the article and zipper cover being constructed and arranged so that the zipper cover is magnetically securable to a surface of the article or a surface of the zippered opening in the first orientation, and so that the zipper cover is magnetically securable against the surface of the article in the second orientation, wherein the zipper cover has a first side and a second side opposite the first side, the first side of the zipper cover being in adjacent facing relation with the surface of the article when the zipper cover is in the second orientation, and the second side of the zipper cover being in facing relation with a surface of the zipper tape when the zipper cover is in the first orientation.

2. The article of claim 1, wherein the zipper cover includes at least one second magnet that is configured to interact with a magnetic zipper or at least one first magnet in the article.

3. The article of claim 2, wherein the surface of the zippered opening includes the at least one first magnet, the at least one first magnet being configured to interact with the at least one second magnet to magnetically secure the zipper cover in the first orientation.

4. The article of claim 3, wherein the surface of the article includes at least one third magnet, the at least one third magnet being configured to interact with the at least one second magnet to magnetically secure the zipper cover in the second orientation.

5. The article of claim 1, wherein the zipper cover has a length that is one of substantially the same as the length of the zipper tape and greater than the length of the zipper tape.

6. The article of claim 1, wherein when the zipper cover is in the first orientation, if the zippered opening is in an unzipped condition, the zipper cover is constructed and arranged to hold the mouth of the zippered opening closed along the length of the zipper tape.

7. The article of claim 1, wherein the zipper cover has a thickness and shape so that an outer surface of the zipper cover is substantially flush with the surface of the article when the zipper cover is in the first orientation.

8. The article of claim 1, wherein the zipper cover has a height that is sufficient to conceal the zipper tape when the zipper cover is in the first orientation.

9. The article of claim 8, wherein the zipper tape extends along its length at least substantially perpendicularly to a height direction of the article, and the zipper cover is secured adjacent one of an upper longitudinal edge of the zipper tape and a lower longitudinal edge of the zipper tape.

10. The article of claim 1, wherein the zipper cover preferably comprises at least one of leather and plastic.

11. The article of claim 1, further comprising:

at least one zipper slider coupled to the zipper tape; and at least one zipper pull-tab, each zipper pull-tab coupled to a respective zipper slider of the at least one zipper slider, the zipper cover being configured to cover the at least one zipper slider and the at least one zipper pull-tab when the zipper cover is in the first orientation.

12. The article of claim 1, wherein the article is preferably one of a suitcase and a briefcase.

13. The article of claim 1, wherein the surface of the article is preferably one of a front face and a rear face of the article.

14. The article of claim 1, wherein the zipper cover is connected to the article by a hinge type connection that allows the zipper cover to rotate between the first orientation and the second orientation.

15. The article of claim 1, wherein the zipper cover is integrally formed with the article.

16. A method of selectively covering a zipper tape secured at a mouth of a zippered opening in a surface of an article of luggage, the method comprising:

magnetically securing a zipper cover to a surface of the article or a surface of the zippered opening in a first orientation and magnetically securing the zipper cover to the surface of the article of luggage in a second orientation with respect to the article of luggage, so that the zipper cover extends over the zipper tape when the zipper cover is in the first orientation, and so that the zipper cover exposes the zipper tape and allows access to the zippered opening when the zipper cover is in the second orientation, wherein the zipper cover has a first side and a second side opposite the first side, the first side of the zipper cover being in adjacent facing relation with the surface of the article when the zipper cover is in the second orientation, and the second side of the zipper cover being in facing relation with a surface of the zipper tape when the zipper cover is in the first orientation.

17. The method of claim 16, further comprising:

providing the surface of the zippered opening with at least one first magnet, providing the zipper cover with at least one second magnet, and configuring the at least one first magnet to interact with the at least one second magnet to magnetically secure the zipper cover in the first orientation.

18. The method of claim 17, further comprising providing the surface of the article of luggage with at least one third magnet, and configuring the at least one third magnet to interact with the at least one second magnet to magnetically secure the zipper cover in the second orientation.

19. The method of claim 16, further comprising securing the zipper cover adjacent one of an upper longitudinal edge of the zipper tape and a lower longitudinal edge of the zipper tape.

20. The method of claim 16, further comprising when the zipper cover is in the first orientation, if the zippered opening is in an unzipped condition, holding the mouth of the zippered opening closed along a length of the zipper tape with the zipper cover.

21. The method of claim 16, further comprising entirely covering the zipper tape with the zipper cover when the zipper cover is in the first orientation.

22. The method of claim 21, further comprising entirely covering at least one zipper slider coupled to the zipper tape and entirely covering at least one zipper pull-tab coupled to the at least one zipper slider when the zipper cover is in the first orientation.

23. An article having a zipper tape secured at a mouth of a zippered opening in a surface of the article, the article comprising a zipper cover constructed and arranged so as to conceal the zipper tape and to longitudinally extend substantially parallel to a length of the zipper tape, the zipper cover being attached to the surface of the article and being constructed and arranged so as to be rotatable between a first orientation and a second orientation, the zipper cover extending over the zipper tape to conceal the zipper tape when in the first orientation, and the zipper cover exposing the zipper tape and allowing a user to access the zippered opening when in the second orientation, the article and zipper cover being constructed and arranged so that the zipper cover is magnetically securable to a surface of the article or a surface of the zippered opening in the first orientation, and so that the zipper cover is magnetically securable against the surface of the article in the second orientation, wherein the zipper tape extends along its length at least substantially perpendicularly to a height direction of the article, and the zipper cover is secured adjacent one of an upper longitudinal edge of the zipper tape and a lower longitudinal edge of the zipper tape.

* * * * *